United States Patent [19]

Adachi et al.

[11] 4,381,233

[45] Apr. 26, 1983

[54] PHOTOELECTROLYZER

[75] Inventors: Toshio Adachi; Tatsumi Arakawa, both of Fuji, Japan

[73] Assignee: Asahi Kasei Kogyo Kabushiki Kaisha, Osaka, Japan

[21] Appl. No.: 263,055

[22] Filed: May 13, 1981

[30] Foreign Application Priority Data

May 19, 1980 [JP] Japan ..... 55-65288
Jun. 26, 1980 [JP] Japan ..... 55-85873

[51] Int. Cl.[3] ..... C25B 1/00; C25B 1/02; C25B 9/00

[52] U.S. Cl. ..... 204/242; 136/249; 136/250; 136/258; 204/128; 204/129; 204/266; 204/DIG. 3

[58] Field of Search ..... 204/242, 266, 128, 129, 204/DIG. 3; 429/111; 136/249 TJ, 250, 258 AM

[56] References Cited

U.S. PATENT DOCUMENTS 4,064,521 12/1977 Carlson ..... 357/2
4,094,751 6/1978 Nozik ..... 204/80
4,100,051 7/1978 Kilby ..... 204/266
4,136,436 7/1979 Kilby ..... 29/572
4,173,494 11/1979 Johnson et al. ..... 136/250
4,200,473 4/1980 Carlson ..... 136/255
4,271,328 6/1981 Hamakawa et al. ..... 136/249

OTHER PUBLICATIONS

Advertisement, Johnson Wax Co., Racine, Wisconsin
*Chemical & Engineering News,* Jun. 9, 1980.

*Primary Examiner*—Aaron Weisstuch
*Attorney, Agent, or Firm*—Armstrong, Nikaido, Marmelstein & Kubovcik

[57] ABSTRACT

There is presented a photoelectrolyzer comprising a number of minute solar cell elements suspended in an electrolyte. Each element is made of, for example, a first thin film of intrinsic amorphous silicon having specific properties and/or N-type amorphous silicon and a second thin film of a P-type amorphous silicon.

This apparatus is high in the sunlight collection efficiency and also is capable of electrolyzing an electrolyte with high electrolysis voltage such as water.

16 Claims, 7 Drawing Figures

PHOTOELECTROLYZER

BACKGROUND OF THE INVENTION

1. Field of the Invention

This invention relates to a photoelectrolyzer utilizing a number of solar cell elements.

2. Description of the Prior Art

In recent years, solar cells have been developed for generating electricity from sunlight. For this purpose, a solar cell is required to have a large area. But, in a thin film which is necessary for this large area requirement, as well as the need for a low cost of the solar cell, a short circuit may result only at some local part therein, whereby the performance of a solar cell as a whole is lowered. Further, for better utilization of sunlight, it is also desired to have a complicated apparatus which will permit a solar cell to follow the motion of the sun.

Attempts have been made to utilize a solar cell having such a large area as an electrolyzer; however, it has been difficult to utilize the sunlight with good efficiency. J. S. Kilby et al of Texas Instrument Co. discloses electrolyzers having minute solar cells arranged on a plane.

Such electrolyzers, having elements arranged on a plane, are inferior for efficient utilization of light. The process for preparation of the solar cell elements is also relatively complicated. Further, as an additional disadvantage, it is impossible to obtain a high voltage due to structural reasons and, therefore, electrolyzable electrolytes are limited.

In view of the disadvantages of the prior art as mentioned above, the present inventors have made extensive studies to develop an electrolyzer free from these drawbacks. As the result, they were successful in inventing a photoelectrolyzer comprising a number of minute solar cell elements, each having a maximum size in the range from 5 μm to 5 mm, suspended in an electrolyte.

SUMMARY OF THE INVENTION

An object of this invention is to provide a photoelectrolyzer which is highly efficient for collection of sunlight.

The photoelectrolyzer of the present invention comprises a number of minute solar cell elements, each having a maximum size in the range from 5 μm to 5 mm, suspended in an electrolyte.

DETAILED DESCRIPTION OF THE INVENTION

Figure 1:
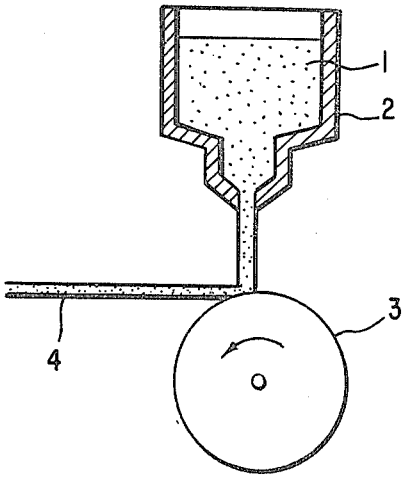
FIG. 1 shows a cross-sectional view of a schematic drawing indicating the procedure for formation of a silicon ribbon film.

The specific feature of the photoelectrolyzer according to the present invention resides in the suspension of a number of minute solar battery elements with maximum diameters in the range from 5 μm to 5 mm in an electrolyte. When such minute solar cell elements are irradiated with light, an electrolyte can be electrolyzed by the photovoltage generated thereby. These minute solar cell elements are suspended naturally or, if desired, under artificially provided conditions with a water stream in an electrolyte. When the sunlight enters the thus suspended solar cell elements, the entered sunlight will undergo repeated reflections between the minute solar cell elements through scattering. Thus, the energy of the sunlight can be utilized effectively and at the same time there is no substantial change in utilization efficiency of the solar energy even when the angle of incidence of the sunlight upon the device of the present invention may is significantly changed. Further, since no external electric wiring is necessary for the electrolyzer assembly, the apparatus itself can be very simple. In the apparatus according to the present invention, each minute solar cell element forms an independent circuit and, therefore, no bad influences can be transmitted to other solar cell elements even if some elements are rendered unusable.

It is essentially required in the present invention that the solar cell element used have a maximum diameter in the range from 5 μm to 5 mm. An element with a maximum diameter less than 5 μm is inferior in utilization efficiency of the sunlight since when the diameter of the cells approaches the wavelength of light, the scattering probability of light is reduced. On the other hand, elements having a maximum diameter larger than 5 mm are, in most cases difficult to suspend in an electrolyte even when a water stream is generated, and also the effect of irregular reflection inherent in the device will be reduced.

In the present invention, there are employed a large number of minute solar cell elements. While the precise amount depends on the sizes of the elements, it is generally adjusted so that when the sunlight is irradiated over the vessel containing the electrolyte suspension, the light transmittance as measured at the bottom of said vessel may be about 5% or lower.

The electrolyte to be used in the present invention may suitably be selected depending on the photovoltage of the solar cell employed. Thus, there may be included NOCl, KI or HI with relatively lower electrolysis voltages and $H_2O$ and HCl with relatively higher electrolysis voltages. When the reaction products are all gases, the resultant mixed gases can be separated from each other by physical or chemical means. However, since it is difficult to effect separation between gases, it is preferred to use an electrolyte such as KI, HI or HCl wherein one of the electrolytic products is gaseous.

As the material for the solar cell element to be used in the present invention, there may be used crystalline silicon, crystalline gallium-arsenide, crystalline germanium, crystalline gallium-aluminum arsenide, crystalline cadmium sulfide, crystalline cadmium telluride, amorphous silicon, etc.

The solar cell element to be used in the present invention may have a structure similar to conventional solar cell elements, including a PN-junction structure, a hetero-junction structure, a heteroface-junction structure, a PIN-junction structure, a Schottky barrier-junction structure through metal-semiconductor contact, a metal-insulator-semiconductor-junction structure or others. It is not necessarily required to use an electrode for collection of electricity generally used in conventional solar cell elements.

These minute solar cell elements with maximum diameter of 5 μm to 5 mm can be prepared by, for example, a method wherein a solar cell element is formed on a flexible substrate such as an elastic substrate (e.g., rubber) by coating or vacuum evaporation or other suitable method and thereafter bending, or extending and contracting the substrate to form minute solar cell elements shaped as plates or scales by peeling off the minute solar cell elements from the substrate. Alternatively, without use of such a substrate, solar cell elements prepared by use of a ribbon or a wafer of semiconductor which is broken into fine pieces by hand, to form minute solar cell elements.

Further, it is also possible to directly prepare minute semiconductors, followed by suitable treatment, such as impurity diffusion of barrier metal formation.

Referring to FIG. 1, there is shown one embodiment of the procedure for forming a semiconductor ribbon to be used in the solar cell element of the present invention comprising an extrusion means 2 having a nozzle portion with a diameter of 1 mm to 2 mm contains a high purity N-type silicon 1 maintained molten at 1460° C. to 1580° C. and in which a suitable amount of elements from the Periodic Table Group V such as phosphorus or arsenic are present as dopants. Through the extrusion means 2, the N-type silicon is permitted to jet out against a drum 3 rotating at a linear speed of 2 m/sec. to 20 m/sec. and N-type silicon ribbon 4 is obtained in the horizontal direction. The ribbon-like thin silicon film obtained according to this method generally has a thickness of 20 to 150 μm and a width of 1 to 50 mm.

The thus formed N-type silicon ribbon may be subjected to diffusion doping with an element of the Periodic Table Group III, such as boron or aluminum to form a PN-junction, thereby providing a solar cell element. Alternatively, in place of impurity diffusion, $SnCl_4$ gas may be used to form $SnO_2$ by way of a CVD (chemical vapor deposition) method on the N-type silicon ribbon to provide a solar battery element with a heteroface-junction. It is also possible to form a thin silicon oxide layer with thickness of 10 to 80 Å between the $SnO_2$-forming layer and the silicon ribbon by thermal oxidation or vacuum evaporation of $SiO_2$ to provide a solar cell element improved in efficient utilization of sunlight.

Instead of the N-type silicon, there may also be prepared a P-type silicon ribbon, on which chromium is formed by evaporation to a thickness of 30 Å to 100 Å to provide a Schottky barrier type solar cell element. Alternatively, by diffusion doping of an element of the periodic Table Group V such as phosphorus or arsenic, a PN-junction type solar battery element may be prepared.

There may also be utilized a cadmium sulfide type solar cell element in place of the silicon type solar cell element. As one example of preparation, a CdS film is formed on a polished mirror surface of a P-type cadmium telluride crystal by a $H_2$-CdS gas-phase growth device in a thickness of about 20 μm on the CdTe surface, further followed by heat treatment in a hydrogen gas stream containing vapors of indium to thereby decrease the resistance of the CdS, thus providing a film-like cadmium sulfide type solar battery element.

By breaking the solar cell element in the shape of a wafer or a ribbon prepared as described above into fine pieces by hand, there can be obtained a large number of minute solar cell elements.

Figure 2:
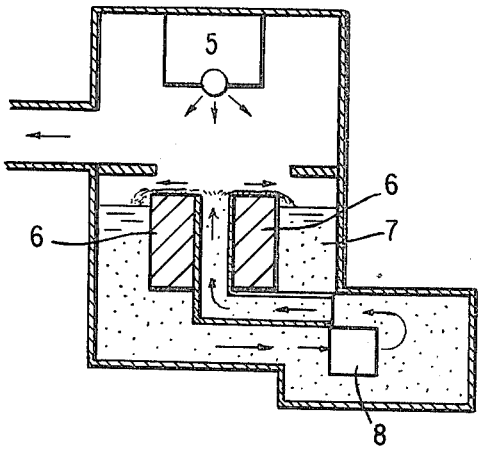
FIG. 2 is a cross-sectional view of a device for forming minute semiconductors.

Alternatively, minute semiconductor particles can be directly prepared and suitable treatments applied thereto to prepare solar cell elements of the present invention. While this method may be cumbersome in the treatment operations, particles with uniform sizes can be advantageously obtained. Referring now to several examples of direct preparation of minute semiconductor particles, the most simple method comprises pulverizing an ingot or a wafer of silicon into powder. According to another method, fused silicon maintained at about 1500° C. is atomized through a nozzle and permitted to form spherical particles through surface tension and solidified during falling to provide minute particles with sizes of 0.1 μm to 100 μm. Also, as shown in the example of FIG. 2, a semiconductor may be vaporized by heating in an inert gas and a fume of minute particles, generated by cooling with a gas, is received and collected in an oil bath. To explain in further detail, the silicon in an evaporation source 5 is evaporated by heating in argon gas atmosphere of $2\times10^{-5}$ torr or less. Below the evaporation source, there is disposed a rotating disc 6 and silicon is evaporated downwardly. On the backside of the disc, there is adhered a thin iron plate, which iron plate is roated by a magnet provided outside of the vacuum system. The oil from bath 7 is permitted to be jetted out from the center of the rotating disc by means of a pump 8. The oil flowing on the disc, after it has been exposed to the silicon vapor, will fall into the concentric cylindrical oil bath 7. The fallen oil is again jetted out through the pump and the content of minute silicon particles is gradually increased therein. The thus formed minute particles, which are still contained in oil, may be collected by utilizing a centrifuge, by vacuum distillation or by precipitation with a solvent. The particles prepared according to this method will have sizes of 300 Å to 30 μm. The thus prepared minute semiconductors are N-type when the starting materials used are N-type, or P-type when P-type starting materials are used.

Figure 3:
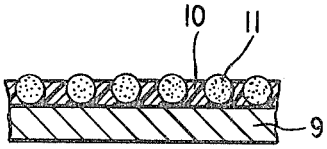
FIG. 3 is a cross-sectional view of one embodiment of a substrate coated with minute particles in a resin matrix for formation of a PN-junction or barrier metal on the minute particles.

The minute particles of silicon semiconductor may be converted to Schottky barrier type minute particle solar cell elements by application of chromium on one surface of minute P-type silicon particles by vacuum evaporation or sputtering. Preparation of PN-junction type solar cell elements is possible by vacuum evaporation or coating of a substance belonging to the group V or the group III elements of the Periodic Table on a number of P-type or N-type particles arranged on a flat plate, followed by heating to effect thermal diffusion to form PN-junctions. Alternatively, to more positively effect PN-junction formation, a mixture of minute particles and a resin such as polymethylmethacrylate, polystyrene, polyvinyl chloride or nitrocellulose is dissolved in a solvent and coated on a substrate of metal, glass or plastics, as shown in FIG. 3, followed by evaporation of the solvent to solidify the coating, whereby a part of the semi-conductor particles will be exposed. Then, a suitable substance of the group V or the group III elements of the Periodic Table is coated or vacuum-evaporated on the whole coated film to thereby effect thermal diffusion to form PN-junctions in the minute particles. Subsequently, the resin 10 is dissolved with a solvent and the minute particles are collected from the substrate to give a number of PN-type minute particle solar battery elements. Similarly, in place of impurity diffusion of the group V or the group III of the Periodic Table, a metal may be deposited by vacuum evaporation to give minute solar cell elements.

Having thus described the preparation of solar cell elements using crystalline materials, it is also possible to employ amorphous silicon for preparation of solar cell elements which has recently attracted attention as a low cost material.

A solar cell element using amorphous silicon can easily be manufactured and also has a structure capable of generating a high photovoltage, and therefore it is particularly suitable for the purpose of the present invention.

The amorphous silicon solar cell element to be used as a photoelectrolyzer of the present invention comprises generally a first layer composed of intrinsic amorphous silicon, having a carrier life of $10^{-7}$ sec. or longer, an average localized state density in the forbidden gap of not more than $10^{17}/cm^3$ and an active region in which carrier mobility is $10^{-3}cm^2/V.sec$ or more, or N-type amorphous silicon prepared by doping said intrinsic amorphous silicon with an N-type impurity, or a combination thereof, and a second film which is formed on one surface of the active region of said first thin film to form a potential barrier and which has a light transmitting property, said second film being at least one selected from the group consisting of a P-type amorphous silicon film prepared by doping of a P-type impurity into said intrinsic amorphous silicon having the aforesaid properties, a thin metal film, and a thin oxide film. For preparation of amorphous silicon as mentioned above, no such cumbersome step such as thermal diffusion for doping is required. Further, a solar cell can be entirely constituted by such amorphous silicon elements. For example, when two or more stacked layers are used, it is possible to obtain a voltage as high as 1 to 5 Volts per single element, and therefore electrolysis of an electrolyte which cannot be electrolyzed by the elements of the prior art is possible by solar cell elements of the present invention.

The intrinsic amorphous silicon to be used in the present invention is required to have a life time of electrons and positive holes excited by light which should be sufficiently long, namely at least $10^{-7}$ sec. Also since the width of the depletion layer region is inversely proportional to the root of the average localized state density, the average localized state density in the forbidden gap is required to be $10^{17}/cm^3$ or less in order that said width be at least about 1 $\mu$m. Further, for obtaining sufficiently high current collecting efficiency, it is also required that the mobility of electrons and positive holes be $10^{-3}cm^2/V.sec$ or more. Such an intrinsic amorphous silicon film may be formed by the sputtering method or the plasma glow discharge decomposition method. The sputtering method may be conducted by first evacuating a vacuum vessel to $10^{-7}$ torr to 1 torr, then feeding a mixed gas comprising an inert gas, such as argon, with hydrogen into the vacuum vessel to maintain the degree of evacuation at $10^{-4}$ torr to 5 torr. Next, a direct current or a high frequency voltage is applied between the electrodes to create a plasma state in the vacuum vessel. Under such conditions, the target of high purity silicon is sputtered onto a substrate maintained at 150° C. to 400° C. to form an intrinsic amorphous silicon film thereon. Further, N-type amorphous silicon films can be prepared by incorporating a compound containing an element of group V of the Periodic Table such as $PH_3$ or $AsH_3$ into a mixed gas of an inert gas and hydrogen gas, under otherwise the same conditions for preparation of the above intrinsic amorphous silicon.

On the other hand, the plasma glow discharge decomposition method may be conducted by first evacuating a vacuum vessel to $10^{-2}$ torr to $10^{-7}$ torr, followed by feeding of $SiH_4$, $SiF_4$, $SiH_3Cl$, $SiH_2Cl_2$ or $SiHCl_3$, as such or as a dilution with hydrogen gas or argon gas into the vacuum vessel to maintain the gas pressure at 10 torr to $10^{-3}$ torr. Then, a direct current or a high frequency voltage is applied between the electrodes to create a plasma state, under which the above gas is decomposed, whereby amorphous silicon can be formed on a substrate maintained at 150° C. to 400° C. Further, N-type amorphous silicon film can be prepared by incorporating a suitable amount of $PH_3$ or $AsH_3$ into gases of $SiH_4$, etc. under otherwise the same conditions as in the above preparation of the intrinsic amorphous silicon film.

The P-type amorphous silicon to be used as the second thin film may be prepared by using a compound containing an element of the group III of the Periodic Table, such as $B_2H_6$ or $BF_3$ gas in place of $PH_3$ or $AsH_3$ under otherwise the same conditions as in the preparation of N-type amorphous silicon by the sputtering method or the plasma glow discharge decomposition method as described above.

As the first film to be used in the solar cell element, there may be employed an intrinsic amorphous silicon or N-type amorphous silicon prepared according to the above methods, or a combination thereof. Preferably, a combination of these silicons may be used.

The second film to be used in the solar cell must be one which can form a potential barrier by being formed on one surface of said first film. As such a film, there may be mentioned a P-type amorphous silicon film prepared according to the method as described above. In this case, the first film may preferably be an N-type amorphous silicon film, more preferably a combination of an N-type amorphous silicon film and an intrinsic amorphous silicon, said P-type amorphous silicon being formed on the side of said intrinsic amorphous silicon. A metal film, which can also be used as the second thin film, may be prepared by the resistance heating evaporation method. As the metal, there may be employed platinum, gold, palladium or others. In some cases, for further improvement of the characteristics, an intermediate layer may be formed between the first thin film and a metal film. Such an intermediate layer is generally a film with thickness of 10 Å to 400 Å of an oxide material having a relatively low electroconductivity of $10^2$ $\Omega^{-1}.cm^{-1}$, including $SiO_2$, ZnO, $TiO_2$, etc. When the conductivity is higher than $10^2$ $\Omega^{-1}.cm^{-1}$ the intermediate layer cannot exhibit the effects such as the suspension of the carrier flow between the 1st and 2nd film layers and the fixing of charges (holes and electrons) in the intermediate layer. These oxide layers can be formed by oxidation of silicon or by such methods as resistance heating evaporation or electron beam evaporation. There may also be used as the second thin film a transparent electrode, which may preferably be made of indium oxide, tin oxide or a mixture thereof. Such a transparent electrode may be formed by sputtering, resistance heating evaporation, or electron beam evaporation, and the substrate temperature may be controlled during film formation, if desired.

By stacking of the first film and the second film alternately in multiple layers of 2 to 10, there can be obtained an element having higher photovoltage proportional to the increase in number of the layers. An element of this type may more preferably comprise layers, each layer consisting of a first film, which is composed of an intrinsic amorphous silicon film and an N-type amorphous silicon film, and a second film of a P-type amorphous silicon which is provided on the side of said intrinsic amorphous silicon film.

Fur further improvement of photovoltage, there may also be employed a third film of a cermet provided on the second film. The cermet film to be used for the third film is a mixture of a metal and oxides at a suitable mixing ratio, and generally may be formed by the resistance heating evaporation method or the electron beam evaporation method.

The number of unit cells in the stack is from 2 to 10 and photovoltage can be increased in proportion to the number of unit cells, while the current value is decreased in inverse proportion thereto. Further an increase of unit cells will cause difficulty in the processing steps. For this reason, the upper limit of repetition is defined as 10 times.

As previously mentioned, when an elastic rubber substrate or other flexible substrate such as a metal foil or a plastic is used as the substrate, the solar cell element prepared according to the methods as described above can readily be formed into minute solar cell elements by simply peeling off from the substrate by bending or expanding and contracting of the substrate.

Figure 4:
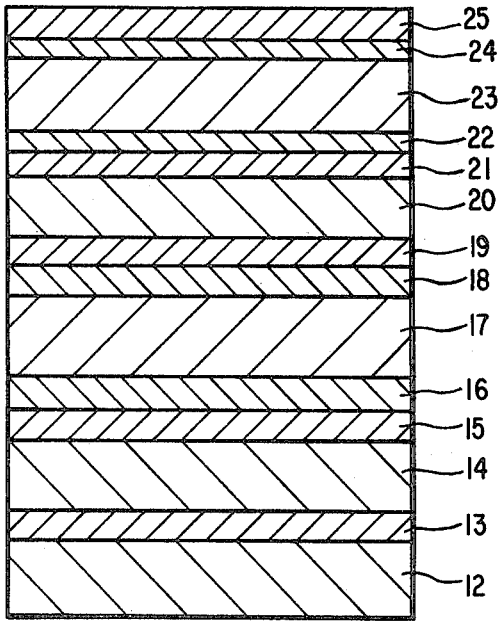
FIG. 4 is a cross-sectional view of a multi-junction type amorphous silicon solar cell.

Referring to FIG. 4, an example of a multi-stack solar cell construction is explained below. A stainless steel foil 12 is used as substrate and an amorphous silicon film is formed by the plasma glow discharge decomposition method, wherein the silicon film is formed under the conditions of 280° C. substrate temperature, and $SiH_4$ gas as formation gas without dilution. While maintaining the $SiH_4$ gas at about 0.5 torr, a high frequency glow discharge was effected. First, N-type amorphous silicon layer 13 (hereinafter referred to as N-type) is formed in a thickness of 500 Å by incorporation of $PH_3$ into $SiH_4$ at a flow ratio ($PH_3/SiH_4$) of 0.5%. Then, intrinsic amorphous silicon layer 14 (hereinafter referred to as I-type) was formed in a thickness of 5000 Å on said N-type layer 13 to provide a first film, followed further by formation of a P-type amorphous silicon layer 15 (hereinafter referred to as P-type) doped with $B_2H_6$ at a flow ratio ($B_2H_6/SiH_4$) of 0.2% in a thickness of 100 Å to provide a second film. Sequentially, the second unit cell was formed, with similar amounts of doping comprising N-type layer 16, I type layer 17 and P-type layer 18, in thicknesses of 300 Å, 1000 Å and 80 Å, respectively. The third unit cell was also formed of N-type layer 19, I-type layer 20 and P-type layer 21 in thicknesses of 200 Å, 400 Å and 65 Å, respectively. Likewise, the fourth cell consisted of N-type layer 22, I-type layer 23 and P-type layer 24 in thicknesses of 100 Å, 200 Å and 50 Å, respectively. In this case, the thicknesses were made thinner toward the upper stages. The total thickness of the amorphous silicon film was adjusted from 0.5 μm to 2.0 μm. When the thickness is too thick, the carriers formed by the sunlight cannot diffuse to the upper and lower electrodes, while when it is too thin, light absorption is insufficient which lower efficiency. Then, indium oxide containing 3% tin oxide mixed therein is vacuum evaporated to a thickness of 1000 to 5000 A by an electron beam under vacuum of $5\times10^{-5}$ torr or less to form an indium oxide-tin oxide film 25 (so called ITO film). Thus, a stacked multi-junction type solar cell can be obtained. Such a solar cell can obtain an open-circuit voltage of 2.0 V to 2.5 V from sunlight. The number of stages from 2 to 10 can optionally be selected depending on the desired voltage.

These minute stacked multi-junction amorphous silicon solar cell elements have the characteristic of obtaining a high voltage without decrease in efficiency and, therefore, it is possible to perform electrolysis of an electrolyte with a higher electrolysis voltage, such as water, which has been impossible with the elements of the prior art. In addition, the photovoltage of the multi-stack solar battery element as exemplified above can be improved by forming a cermet film of a mixture of a metal and an oxide, namely a cermet film comprising a mixture of 10 to 20% by volume of platinum with silicon oxide, in a thickness of about 100 Å between the P-type and N-type amorphous silicon layers, or by further forming a titanium(Ti) film in a thickness of 30 Å to 50 Å between the N-type amorphous silicon layer and the cermet layer. This solar cell can also be formed into scale-like minute solar cell elements by similarly bending or breaking of the substrate as mentioned above.

Figure 5:
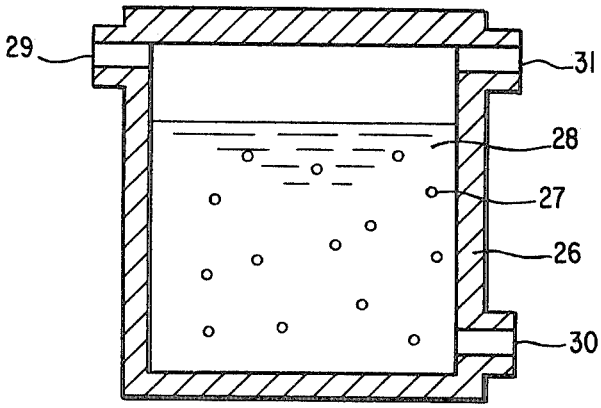
FIG. 5 is a cross-sectional view of one embodiment of the photo-electrolyzer according to the present invention.

Referring to FIG. 5, one embodiment of photoelectrolyzer using the minute solar cell elements as prepared according to the above procedures is explained below. Materials for the solar cell may include crystalline silicon, crystalline gallium arsenide, crystalline germanium, crystalline gallium-aluminum arsenide, crystalline cadmium sulfide, crystalline cadmium telluride and amorphous silicon. This embodiment comprises a photoelectrolyzer having a suspension of minute solar cell elements 27 in an electrolyte 28 contained in a vessel 26. The upper part and side parts of the vessel 26 may be made of transparent materials. Alternatively, depending on the electrolysis products, the upper part may be opened so that the energy of the sunlight may be supplied to the solar cell elements, simultaneously with provision of outlets 29, 31 for taking out the electrolysis products as well as supply inlet 30 for charging electrolytes into the vessel. Inlet 30 or outlets 29,31 may sometimes not necessarily be provided. When they are provided, their numbers or their positions can be changed in various ways depending on the reaction products, starting materials and supplying methods. There may be also provided a filter at the outlet in order to separate the reaction product from the solar cell elements.

EXAMPLE 1

Minute solar cell elements were prepared according to the following procedure. There was prepared a P-type silicon ribbon according to the roller method as explained in FIG. 1. This ribbon was immersed in an aqueous 50% hydrofluoric acid solution for 30 minutes or longer for etching of the surface, followed by coating with a $P_2O_5$ coating solution, and then heat diffusion treatment was conducted at 1100° C. for 60 minutes to form PN-junctions. Subsequently, the surface treatment was effected by immersing the product in an aqueous 50% hydrofluoric acid for one minute. The thus prepared solar cell, which can also be used as such, was further subjected to mesa etching in order to improve the conversion efficiency of light. Namely, after coating with an electron wax, the solar battery was treated with a mixture of nitric acid/hydrofuluoric acid (4/1), followed by washing with trichlene, acetone and water to remove the electron wax. The thus obtained ribbon type solar cell was broken by hand into minute solar cell elements with sizes of 0.2 μm to 2 mm. As the electrolyte, there was used an aqueous 10% NOCl solution, and the electrolyzer as shown in FIG. 5 was used. The amount of the solar cell elements suspended is 1 g based on 100 g of the electrolyte.

The electrolysis products, however, were collected as a mixture of dinitrogen monooxide gas and chlorine gas. When HI is used in place of NOCl, hydrogen gas was collected by separation. From the above experiments, there was observed the gas generation per vertical incident area ($cm^2$) of the sun with intensity of 100 $mW/cm^2$ for 1 minute as follows:

NOCl . . . 0.13 $cc/cm^2.min.(N_2O, Cl_2)$

HI . . . 0.04 $cc/cm^2.min.$ $(H_2)$

The amount of hydrogen gas generated when using solar cell elements as shown in FIG. 4 and water as electrolyte in the device as shown in FIG. 5 was 1.2 $cm^3$/hour per 1 $cm^2$ with sunlight of intensity of 100 $mW/cm^2$.

EXAMPLE 2

Figure 6A:
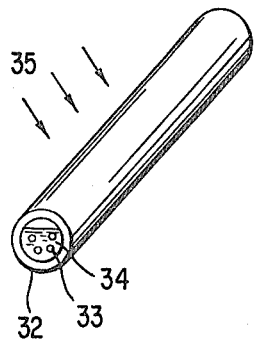
FIG. 6(a) is a perspective view, partially broken, of another embodiment of the photoelectrolyzer according to the present invention.
Figure 6B:
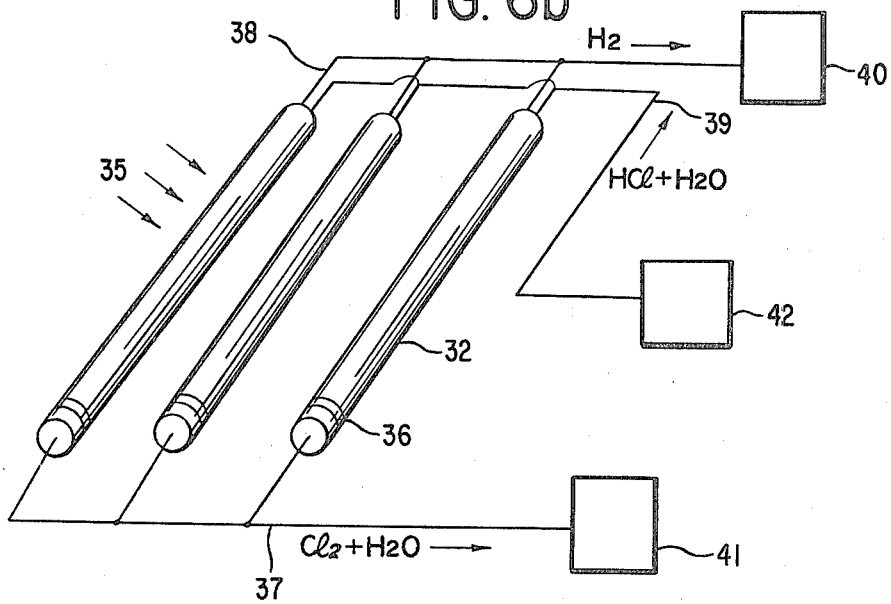
FIG. 6(b) is a perspective view of an assembly in which a plurality of photoelectrolyzers as shown in FIG. 6(a) are employed.

In FIG. 6, there is shown an embodiment using a number of stacked multi-junction amorphous silicon solar cells for electrolysis of HCl. The minute amorphous silicon solar cells with sizes of 10 to 200 μm used in this Example are as shown in FIG. 4. The amount of the solar cell elements is 1 g based on 100 g of the electrolyte. FIG. 6(*a*) shows a perspective view, partially broken, of an electrolyzer in which a suspension of four-junction type amorphous silicon solar cell elements 33 in 3% hydrochloric acid 34 is contained in a cylindrical glass tube 32. In this case, glass tubes are employed in order to permit the sunlight 35 to transmit therethrough; there may also be employed transparent plastic materials in place thereof. The glass tube was made cylindrical so that the light from any direction might be utilized effectively by collection of the incident light through the lens action of the cylindrical glass and the solution. FIG. 6(*b*) shows a perspective view of an electrolyzer system in which three electrolyzers as shown in FIG. 6(*a*) are arranged in a pipe-like assembly. When this reactor is exposed to light, hydrogen gas and an aqueous chlorine solution are produced. This arrangement was so designed that the hydrogen gas and aqueous chlorine solution produced in a number of reactors as used in FIG. 6(*a*) might be collected. The hydrogen gas generated in the glass tube was collected via the conduit 38 in a vessel 40. The aqueous chlorine solution was collected through a filter 36 which did not permit permeation of solar cell cells through the conduit 37 into vessel 41. Aqueous hydrochloric acid was supplied from vessel 42 through the conduit 39 to the glass tube for the photoelectrolysis reaction.

The amount of hydrogen generated by electrolysis of hydrochloric acid as electrolyte using the solar battery elements shown in FIG. 4 in a device as shown in FIG. 6(*b*) was found to be 1.1 $cm^3$/hour per 1 $cm^2$ of the vertical incident area of the sunlight (100 $mW/cm^2$).

As described above, the device according to the present invention, containing a suspension of solar cell elements, is high in sunlight collection efficiency, whereby a complicated device for tracking the sunlight is not essentially required. Furthermore, the individual particles have independent electric circuits and no bad influence is caused on other elements by damaged elements. This is another advantage of the invention. In addition, an electrolyzer employing a multi-junction type amorphous silicon solar cell is suitable for electrolysis of an electrolyte with a high electrolysis voltage which cannot be electrolyzed by any device of the prior art. Further, as is well known in the art of amorphous silicon solar cell elements, the manufacturing process can be very simple to give products with high stable characteristics.

What is claimed is:

1. A photoelectrolyzer comprising a number of minute solar cell elements suspended in an electrolyte, each solar cell element comprising at least one layer which is constituted by at least a first thin film composed of intrinsic amorphous silicon, having a carrier life of $10^{-7}$ sec or longer, an average localized state density in the forbidden gap of not more than $10^{17}/cm^3$ and an active region in which carrier mobility is $10^{-1}cm^2/V.sec$ or more, or N-type amorphous silicon prepared by doping said intrinsic amorphous silicon with an N-type impurity, or both thereof, and a second thin film which is formed on one surface of the active region of said first thin film, thereby forming a potential barrier therewith, said second thin film being light transmissive.

2. A photoelectrolyzer according to clam 1, wherein the solar cell element has a P-type amorphous silicon film as the second thin film.

3. A photoelectrolyzer according to claim 2, wherein the solar cell element has an N-type amorphous silicon film as the first thin film.

4. A photoelectrolyzer according to claim 2, wherein the solar cell has an N-type amorphous silicon film and an intrinsic amorphous silicon film as the first thin film, and having the second amorphous silicon thin film on the side of said intrinsic amorphous silicon thin film.

5. A photoelectrolyzer according to claim 1, wherein the second thin film of the solar cell element is a thin metal film.

6. A photoelectrolyzer according to claim 1, wherein the second thin film of the solar cell element comprises an intermediate layer and a light transmitting thin metal film formed thereon.

7. A photoelectrolyzer according to claim 6, wherein the intermediate layer is a thin oxide film having an electroconductivity of $10^{2\Omega-1}.cm^{-1}$ or less.

8. A photoelectrolyzer according to claim 1, wherein the second film of the solar cell element comprises a transparent electrode film.

9. A photoelectrolyzer according to claim 8, wherein the transparent electrode is constituted of indium oxide, tin oxide or a mixture thereof.

10. A photoelectrolyzer according to claim 1, wherein the solar cell element has a laminated structure having 2 to 10 of said layers so that the first film and the second film may be alternately stacked on each other.

11. A photoelectrolyzer according to claim 10, wherein the first film is constituted of the intrinsic amorphous silicon film and the N-type amorphous silicon film, and the second film is constituted of a P-type amorphous silicon film formed on the side of said intrinsic amorphous silicon film.

12. A photoelectrolyzer according to claim 1, wherein the solar cell element has a laminated structure comprising 2 to 10 layers stacked successively on each other, each layer consisting of a first thin film which is constituted of an intrinsic amorphous silicon film and an N-type amorphous silicon film, a second thin film which is formed on the side of said intrinsic amorphous silicon film and constituted of a P-type amorphous silicon film and a third thin film which is a thin cermet film.

13. A photoelectrolyzer comprising a number of minute solar cell elements suspended in an electrolyte, each solar cell element comprising at least one layer which is constituted by at least a first thin film composed of intrinsic amorphous silicon, having a carrier life of $10^{-7}$ sec or longer, an average localized state density in the forbidden gap of not more than $10^{17}/cm^3$ and an active region in which carrier mobility is $10^{-3}cm^2/V.sec$ or more, or N-type amorphous silicon prepared by doping said intrinsic amosphous silicon with an N-type impurity, or both thereof, and a second thin film which is formed on one surface of the active region of said first thin film, thereby forming a potential barrier therewith, said second thin film being light transmissive;

wherein the solar cell element has a laminated structure having 2 to 10 of said layers so that the first film and the second film may be alternately stacked on each other.

14. A photoelectrolyzer according to claim 13 wherein the first film is constituted of the intrinsic amorphous silicon film and the N-type amorphous silicon film, and the second film is constituted of a P-type amorphous silicon film formed on the side of said intrinsic amorphous silicon film.

15. A photoelectrolyzer comprising a number of minute solar cell elements suspended in an electrolyte, each solar cell element comprising at least one layer which is constituted by at least a first thin film composed of intrinsic amorphous silicon, having a carrier life of $10^{-7}$ sec or longer, an average localized state density in the forbidden gap of not more than $10^{17}/cm^3$ and an active region in which carrier mobility is $10^{-3}cm^2/V.sec$ or more, or N-type amorphous silicon prepared by doping said intrinsic amorphous silicon with an N-type impurity, or both thereof, and a second thin film which is formed on one surface of the active region of said first thin film, thereby forming a potential barrier therewith, said second thin film being light transmissive;

wherein the solar cell element has a laminated structure comprising 2 to 10 layers stacked successively on each other, each layer consisting of a first thin film which is constituted of an intrinsic amorphous silicon film and an N-type amorphous silicon film, a second thin film which is formed on the side of said intrinsic amorphous silicon film and constituted of a P-type amorphous silicon film and a third thin film which is a thin cermet film.

16. A photoelectrolyzer according to claim 1 wherein the minute solar cell elements have a maximum size in the range of from 5 $\mu$m to 5 mm.

* * * * *